US009395665B2

(12) United States Patent
Koyanagi et al.

(10) Patent No.: US 9,395,665 B2
(45) Date of Patent: Jul. 19, 2016

(54) HEATING DEVICE, FIXING DEVICE, AND IMAGE FORMING APPARATUS

(71) Applicant: FUJI XEROX CO., LTD., Tokyo (JP)

(72) Inventors: Kiyoshi Koyanagi, Kanagawa (JP); Toru Inoue, Kanagawa (JP); Junpei Amano, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/615,660

(22) Filed: Feb. 6, 2015

(65) Prior Publication Data

US 2016/0011546 A1 Jan. 14, 2016

(30) Foreign Application Priority Data

Jul. 11, 2014 (JP) ..... 2014-142900

(51) Int. Cl.
*G03G 15/20* (2006.01)
*H05B 3/00* (2006.01)
*H05B 3/03* (2006.01)

(52) U.S. Cl.
CPC ..... *G03G 15/2053* (2013.01); *G03G 15/2039* (2013.01); *H05B 3/0014* (2013.01); *H05B 3/03* (2013.01); *G03G 2215/2035* (2013.01)

(58) Field of Classification Search
None
See application file for complete search history.

(56) References Cited

U.S. PATENT DOCUMENTS 5,499,087 A * 3/1996 Hiraoka ..... G03G 15/2064 219/216
2006/0065653 A1* 3/2006 Weber ..... H01C 7/02 219/505
2009/0245900 A1* 10/2009 Kagawa ..... G03G 15/2042 399/329

FOREIGN PATENT DOCUMENTS

JP 2013-11649 A 1/2013

* cited by examiner

*Primary Examiner* — Clayton E Laballe
*Assistant Examiner* — Jas Sanghera
(74) *Attorney, Agent, or Firm* — Sughrue Mion, PLLC

(57) ABSTRACT

A heating device includes a belt member, plural heating elements, and plural resistance elements. The belt member is rotated. The plural heating elements are arranged in a width direction of the belt member and generate heat so as to heat the belt member. The plural resistance elements having positive temperature coefficients are each connected in series with a corresponding one of the plural heating elements. In the heating device, a temperature of the belt member is reduced by an increase in resistances of the plural resistance elements caused by an increase in temperatures of the plural resistance elements.

12 Claims, 12 Drawing Sheets

HEATING DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2014-142900 filed Jul. 11, 2014.

BACKGROUND

Technical Field

The present invention relates to a heating device, a fixing device, and an image forming apparatus.

SUMMARY

According to an aspect of the present invention, a heating device includes a belt member, plural heating elements, and plural resistance elements. The belt member is rotated. The plural heating elements are arranged in a width direction of the belt member and generate heat so as to heat the belt member. The plural resistance elements having positive temperature coefficients are each connected in series with a corresponding one of the plural heating elements. In the heating device, a temperature of the belt member is reduced by an increase in resistances of the plural resistance elements caused by an increase in temperatures of the plural resistance elements.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the accompanying drawings.

Description of Image Forming Apparatus

Figure 1:
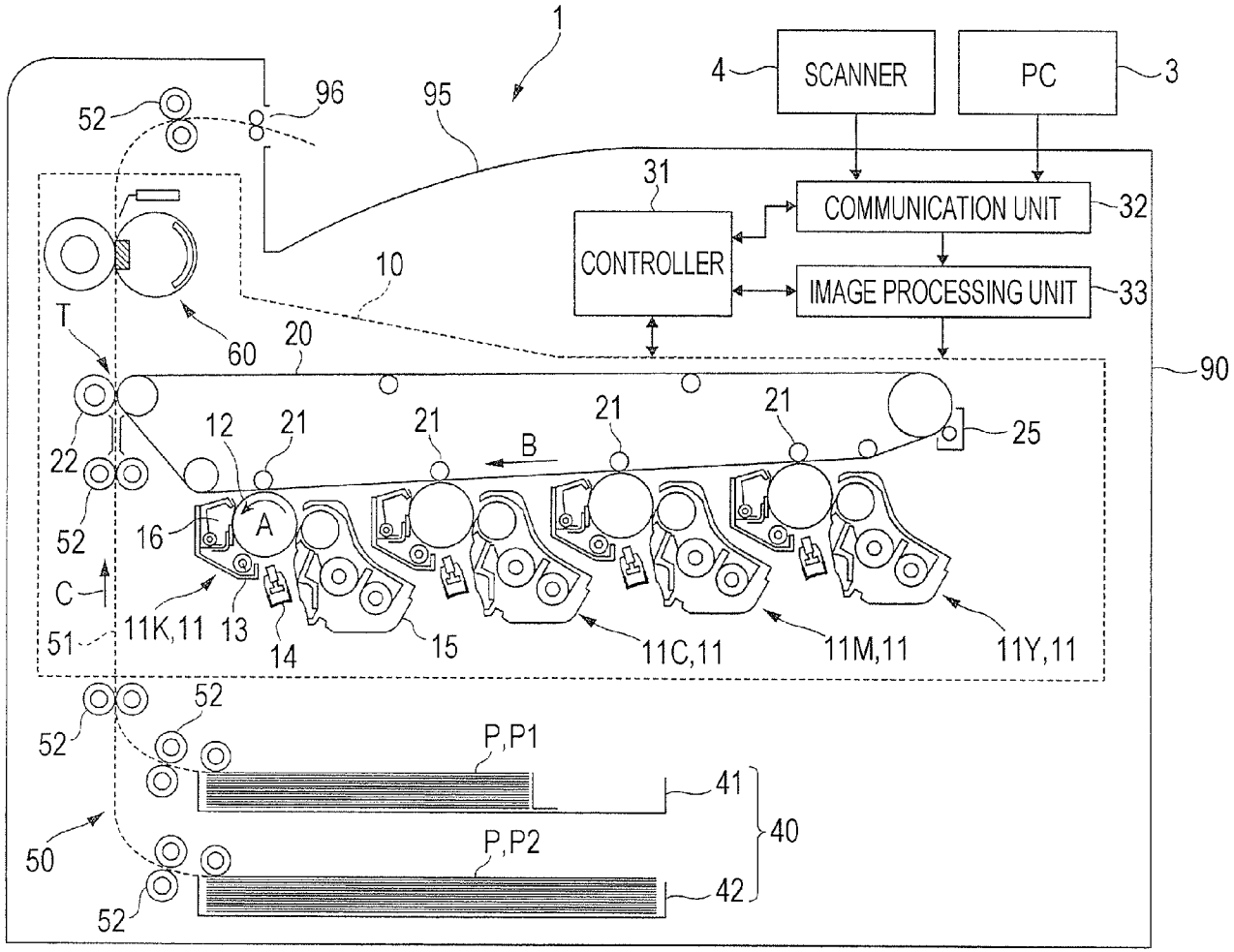
FIG. 1 is a schematic sectional view illustrating an image forming apparatus according to an exemplary embodiment of the present invention.

FIG. 1 is a schematic sectional view illustrating an image forming apparatus 1 according to an exemplary embodiment of the present invention. The image forming apparatus 1 illustrated in FIG. 1 is an electrophotographic laser color printer that prints images in accordance with image data and serves as an example of an image forming apparatus of the present invention.

As illustrated in FIG. 1, this image forming apparatus 1 includes a sheet containing unit 40, an image forming section 10, and a transport unit 50 housed in a body casing 90. The sheet containing unit 40 contains sheets of paper P (serving as an example of recording media). An image forming section 10 forms images on the sheets P. The transport unit 50 transports the sheets P from the sheet containing unit 40 to a sheet ejection slot 96 of the body casing 90 through the image forming section 10. The image forming apparatus 1 also includes a controller 31, a communication unit 32, and an image processing unit 33. The controller 31 controls operations of the entirety of the image forming apparatus 1. The communication unit 32 performs communication with, for example, a personal computer (PC) 3 or an image reading device (scanner) 4 to receive image data. The image processing unit 33 performs image processing on the image data received by the communication unit 32.

The sheet containing unit 40 includes a first sheet container 41 and a second sheet container 42 that each contain a corresponding one of two types of sheets of paper (an example of recording media). The sizes of two types of the sheets are different from each other. The first sheet container 41 contains sheets P1, which are, for example, A4 size sheets. The second sheet container 42 contains sheets P2, which are, for example, B4 size sheets. The "sheets P" may generally refer to the sheets P1 and the sheets P2 hereafter. Also, the sheets P, the sheets P1 and the sheets P2 may be referred to in their respective singular forms "sheet P", "sheet P1" and "sheet P2", when, for example, a single sheet out of the sheets P, a single sheet out of the sheets P1, and a single sheet out of the sheets P2 are described hereafter.

The transport unit 50 includes a transport path 51 for the sheets P and transport rollers 52. The transport path 51 extends from the first sheet container 41 and the second sheet container 42 to the sheet ejection slot 96 through the image forming section 10. The transport rollers 52 transport the sheets P along the transport path 51. The sheets P1 and P2 transported by the transport unit 50 assume, when transported in an arrow C direction along the transport path 51, a position in which the longitudinal directions thereof extend in the arrow C direction which is a feeding direction of the sheets P1 and P2.

The image forming section 10 includes four image forming units 11Y, 11M, 11C, and 11K. The image forming units 11Y, 11M, 11C, and 11K are arranged at predetermined intervals. The image forming units 11Y, 11M, 11C, and 11K may be generally referred to as the "image forming units 11". The image forming units 11 each include a photoconductor drum 12, a charger 13, a print head 14, a developing device 15, and a drum cleaner 16. The photoconductor drum 12 allows an electrostatic latent image to be formed thereon so as to hold a toner image. A surface of the photoconductor drum 12 is charged to a predetermined potential with the charger 13. The print head 14 uses a light emitting diode (LED) and causes the photoconductor drum 12 having been charged with the charger 13 to be exposed to light in accordance with image data for a corresponding one of colors. The developing device develops the electrostatic latent image formed on the surface of the photoconductor drum 12. The drum cleaner 16 cleans the surface of the photoconductor drum 12 after transfer.

Four image forming units 11Y, 11M, 11C, and 11K have similar or the same structures except for toner contained in the developing devices 15. The image forming unit 11Y, which includes the developing device 15 containing yellow (Y) toner, forms a yellow toner image. Likewise, the image forming unit 11M, which includes the developing device 15 containing magenta (M) toner, forms a magenta toner image, the image forming unit 11C, which includes the developing device 15 containing cyan (C) toner, forms a cyan toner image, and the image forming unit 11K, which includes the developing device 15 containing black (K) toner, forms a black toner image.

The image forming section 10 further includes an intermediate transfer belt 20 and first transfer rollers 21. The toner images of the colors formed on the photoconductor drums 12 of the respective image forming units 11 are subjected to multi-transfer onto the intermediate transfer belt 20 performed by superposing these toner images on one another on the intermediate transfer belt 20. The first transfer rollers 21 perform sequential electrostatic transfer (first transfer) of the toner images of the colors formed by the respective image forming units 11 onto the intermediate transfer belt 20. The image forming section 10 further includes a second transfer roller 22 of a second transfer unit T and a fixing unit 60 (an example of a fixing device). The second transfer roller 22 performs collective electrostatic transfer (second transfer) of the superposed toner images onto the sheet P. These superposed toner images are formed by transferring the toner images of the colors onto the surface of the intermediate transfer belt 20 so as to be superposed one another. The fixing unit 60 fixes the superposed toner images having been transferred onto the sheet P through second transfer.

The image forming apparatus 1 performs image forming processing through the following processes under control of the controller 31. That is, image data transmitted from the PC 3 or the scanner 4 is received by the communication unit 32 and subjected to the predetermined image processing performed by the image processing unit 33. After that, the image data is changed into color image data for the respective colors and transmitted to the image forming units 11 of the corresponding colors. For example, in the image forming unit 11K that forms a black toner image, the photoconductor drum 12 is charged to the predetermined potential with the charger 13 while being rotated in an arrow A direction.

After that, the print head 14 causes the photoconductor drum 12 to be exposed to the light that scans the photoconductor drum 12 in accordance with the black image data transmitted from the image processing unit 33. Thus, a black electrostatic latent image corresponding to the black image data is formed on the surface of the photoconductor drum 12. The black electrostatic latent image formed on the photoconductor drum 12 is developed by the developing device 15. Thus, the black toner image is formed on the photoconductor drum 12. Likewise, yellow, magenta, and cyan toner images are respectively formed by the image forming units 11Y, 11M, and 11C.

The toner images of the colors formed on the photoconductor drums 12 of the respective image forming units 11 are sequentially transferred through electrostatic transfer onto the intermediate transfer belt 20 that is being moved in an arrow B direction by the first transfer rollers 21. Thus, the superposed toner images formed of the toner images of the colors superposed on one another are formed on the intermediate transfer belt 20.

By moving the intermediate transfer belt 20 in the arrow B direction, the superposed toner images on the intermediate transfer belt 20 are moved to the second transfer unit T. When the superposed toner images are moved to the second transfer unit T, the sheet P in the sheet containing unit 40 is transported along the transport path 51 in the arrow C direction by the transport rollers 52 of the transport unit 50 at timing at which the superposed toner images are moved. The superposed toner images formed on the intermediate transfer belt 20 are collectively transferred through electrostatic transfer onto the sheet P having been transported along the transport path 51. The electrostatic transfer is caused by a transfer electric field generated by the second transfer roller 22 in the second transfer unit T.

After that, the sheet P onto which the superposed toner images have been transferred through electrostatic transfer is transported to the fixing unit 60 along the transport path 51. The superposed toner images on the sheet P having been transported to the fixing unit 60 are subjected to heat and pressure applied by the fixing unit 60, thereby being fixed onto the sheet P. Then, the sheet P on which the fixed superposed toner images are formed is ejected through the sheet ejection slot 96 of the body casing 90 along the transport path 51 and stacked on a sheet stacking unit 95 on which the sheets P are placed.

Meanwhile, toner remaining on the photoconductor drums 12 after the first transfer and toner remaining on the intermediate transfer belt 20 after the second transfer are respectively removed by the drum cleaner 16 and a belt cleaner 25.

Processing of printing an image on the sheet P is repeatedly performed by the image forming apparatus 1 the number of cycles corresponding to the number of prints.

Description of the Fixing Unit

Figure 2:
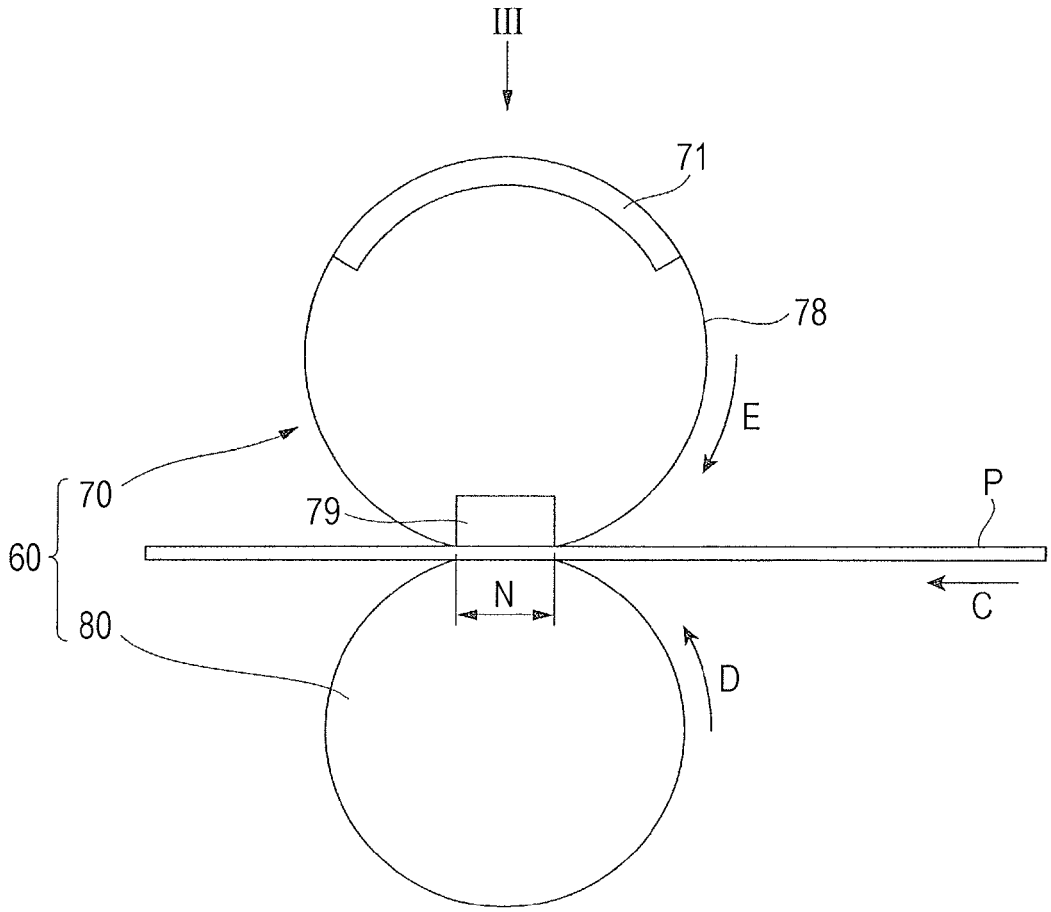
FIG. 2 is a sectional view illustrating the details of a fixing unit of the image forming apparatus.

FIG. 2 is a sectional view illustrating the details of the fixing unit 60 of the image forming apparatus 1. The fixing unit 60 illustrated in FIG. 2 includes a heater unit 70 (an example of a heating device) and a pressure roller 80 (an example of a pressure member). The heater unit 70 and the pressure roller 80 have respective cylindrical shapes. Both the axes of the heater unit 70 and the pressure roller 80 extend in the depth direction of the page of FIG. 2.

As illustrated in FIG. 2, the heater unit 70 includes a rotating fixing belt 78 (an example of a belt member), a solid heater 71, and a pressure pad 79. The solid heater 71 having an arc-shaped section generates heat. The pressure pad 79 is pressed by the pressure roller 80 through the fixing belt 78.

The original shape of the fixing belt 78 is an endless cylindrical shape. The fixing belt 78 is disposed such that an inner circumferential surface of the fixing belt 78 is in contact with an outer circumferential surface of the solid heater 71 and the pressure pad 79. The fixing belt 78 is heated through its contact with the solid heater 71.

The pressure roller 80 is in pressure contact with an outer circumferential surface of the fixing belt 78, thereby forming a nip portion N therebetween. Each of the sheets P holding unfixed superposed toner images passes through the nip portion N. The pressure roller 80 is rotated in an arrow D direction by a drive device, which is omitted from FIG. 2.

The sheet P transported to the nip portion N by the transport unit 50 (see FIG. 1) is heated by the fixing belt 78 and subjected to pressure applied by the pressure roller 80 and the pressure pad 79 through the fixing belt 78 in the nip portion N. Thus, the unfixed superposed toner images held by the sheet P are fixed onto the sheet P.

In the nip portion N, the sheet P in contact with the pressure roller 80 is fed in the arrow C direction by rotation of the pressure roller 80 in an arrow D direction. The fixing belt 78 in contact with the sheet P follows the movement of the sheet P, thereby rotating in an arrow E direction (rotating direction).

Description of the Solid Heater

Figure 3:
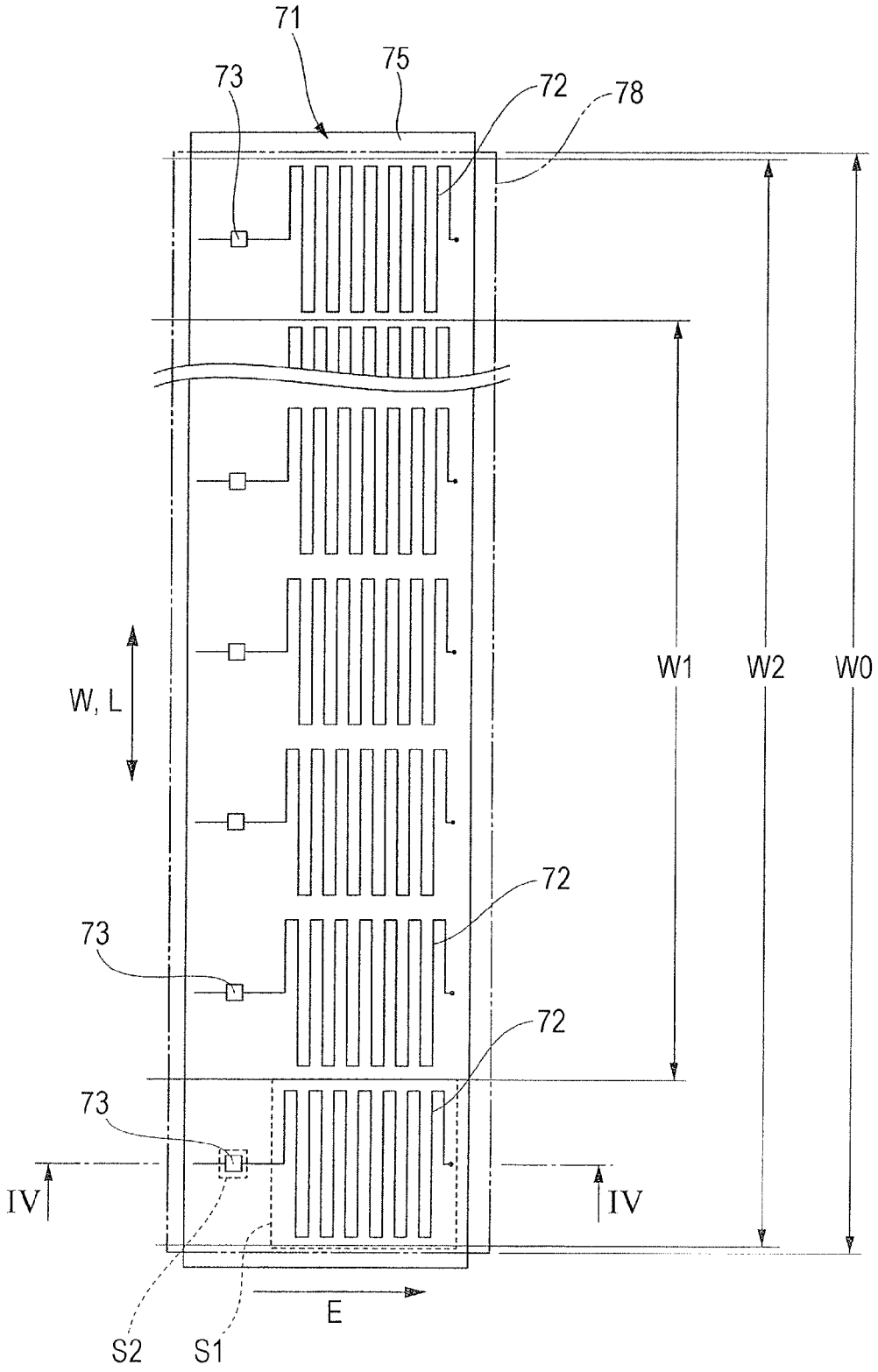
FIG. 3 illustrates a solid heater illustrated in FIG. 2 seen in an arrow III direction illustrated in FIG. 2.
Figure 4:
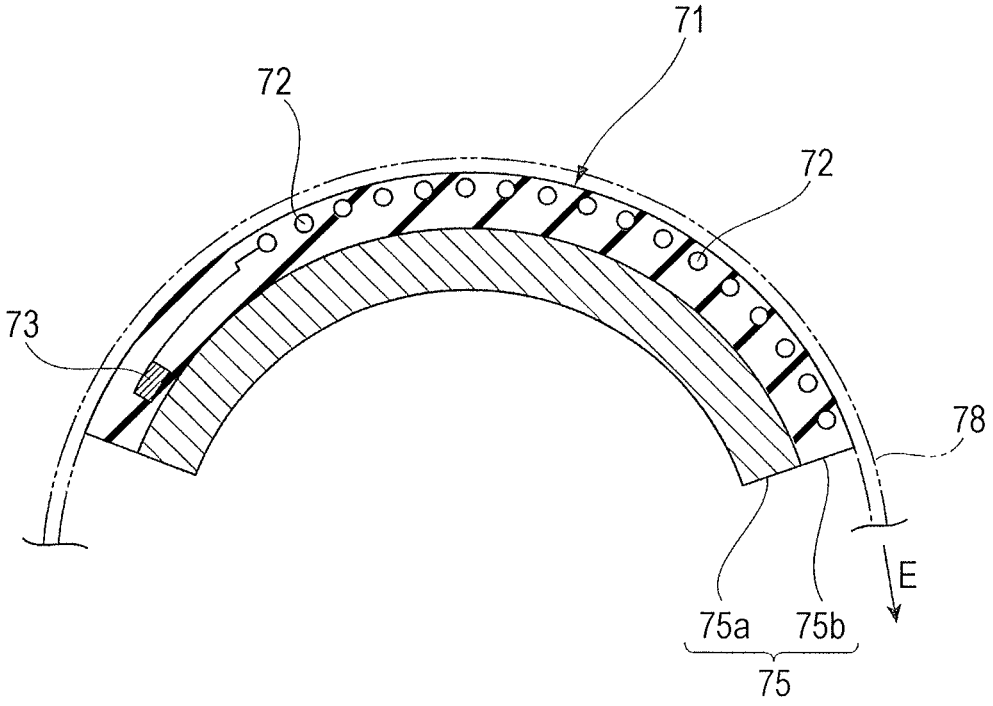
FIG. 4 is a sectional view of the solid heater taken along line IV-IV illustrated in FIG. 3.
Figure 5:
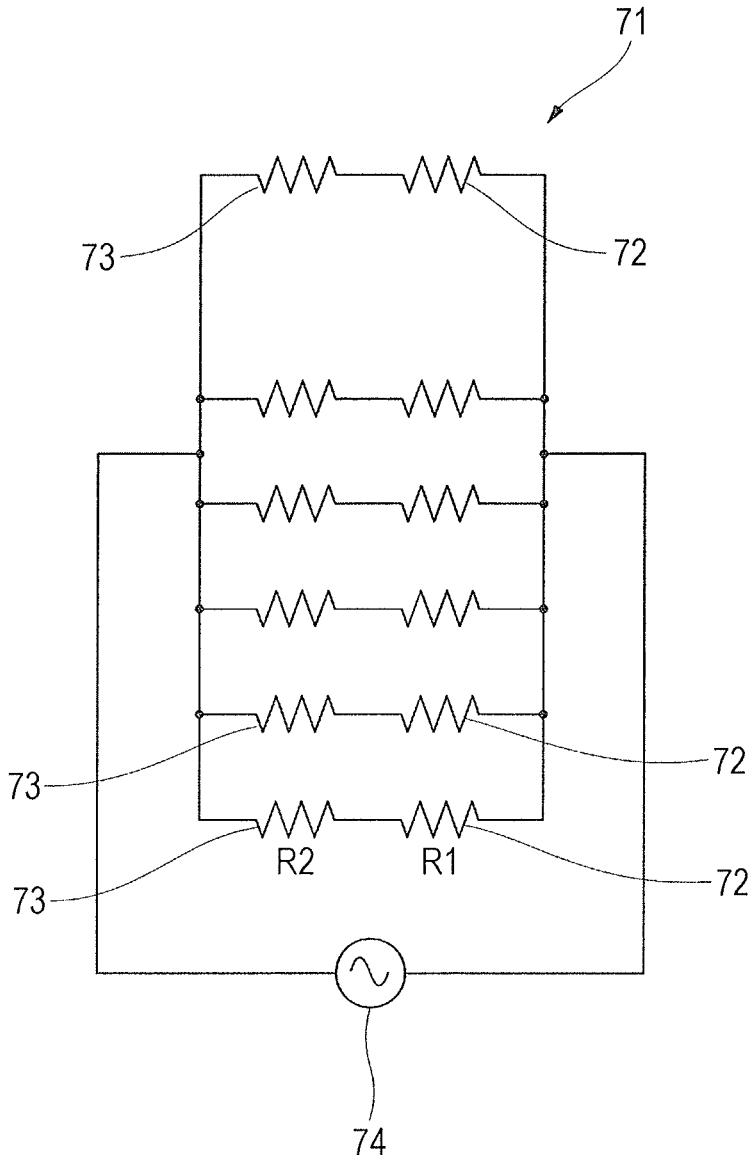
FIG. 5 illustrates an electrical circuit of the solid heater.

FIG. 3 illustrates the solid heater 71 seen in an arrow III direction illustrated in FIG. 2. FIG. 4 is a sectional view taken along line IV-IV illustrated in FIG. 3. FIG. 5 illustrates an electrical circuit of the solid heater 71. As illustrated in FIG. 3, the solid heater 71 includes resistance heating elements 72 (each serving as an example of a heating element), positive temperature coefficient (PTC) elements 73 (each serving as an example of a resistance element having a positive temperature coefficient), and a support member 75. The PTC elements 73 are formed of a material such as, for example, barium titanate. The support member 75 supports the resistance heating elements 72 and the PTC elements 73.

The support member 75 extends in a width direction W of the fixing belt 78 and has an arc-shaped section as illustrated in FIG. 4. The support member 75 includes a base material 75*a* disposed on a radially inner side thereof and a glass coat 75*b*, which is a multilayer structure disposed radially outside the base material 75*a*. The base material 75*a* is formed of, for example, stainless steel or a clad material made by joining stainless steel and copper in the thickness direction.

The fixing belt 78 is looped over an outer circumferential surface of the glass coat 75*b* and rotated forward in the arrow E direction while being in contact with the glass coat 75*b*.

As illustrated in FIG. 3, the plural resistance heating elements 72 and the plural PTC elements 73 are arranged in a direction in which the solid heater 71 extends (hereafter referred to as a longitudinal direction L. The longitudinal direction of the fixing unit 60 and the longitudinal direction of the heater unit 70 are coincident with the longitudinal direction L of the solid heater 71. The longitudinal direction L is coincident with the width direction W of the fixing belt 78).

Each of the resistance heating elements 72 generates heat when energized. Each of the plural PTC elements 73 is, as illustrated in FIG. 5, connected in series to a corresponding one of the resistance heating elements 72. As illustrated in FIG. 3, the PTC elements 73 are disposed upstream of the resistance heating elements 72 in the arrow E direction, which is the fixing belt 78 rotating direction.

Each of the resistance heating elements 72 and a corresponding one of the PTC elements 73 connected in series with each other form an element set, and there are element sets arranged in the longitudinal direction L of the solid heater 71. As illustrated in FIG. 5, the element sets are connected in parallel with a power source 74.

Figure 6:
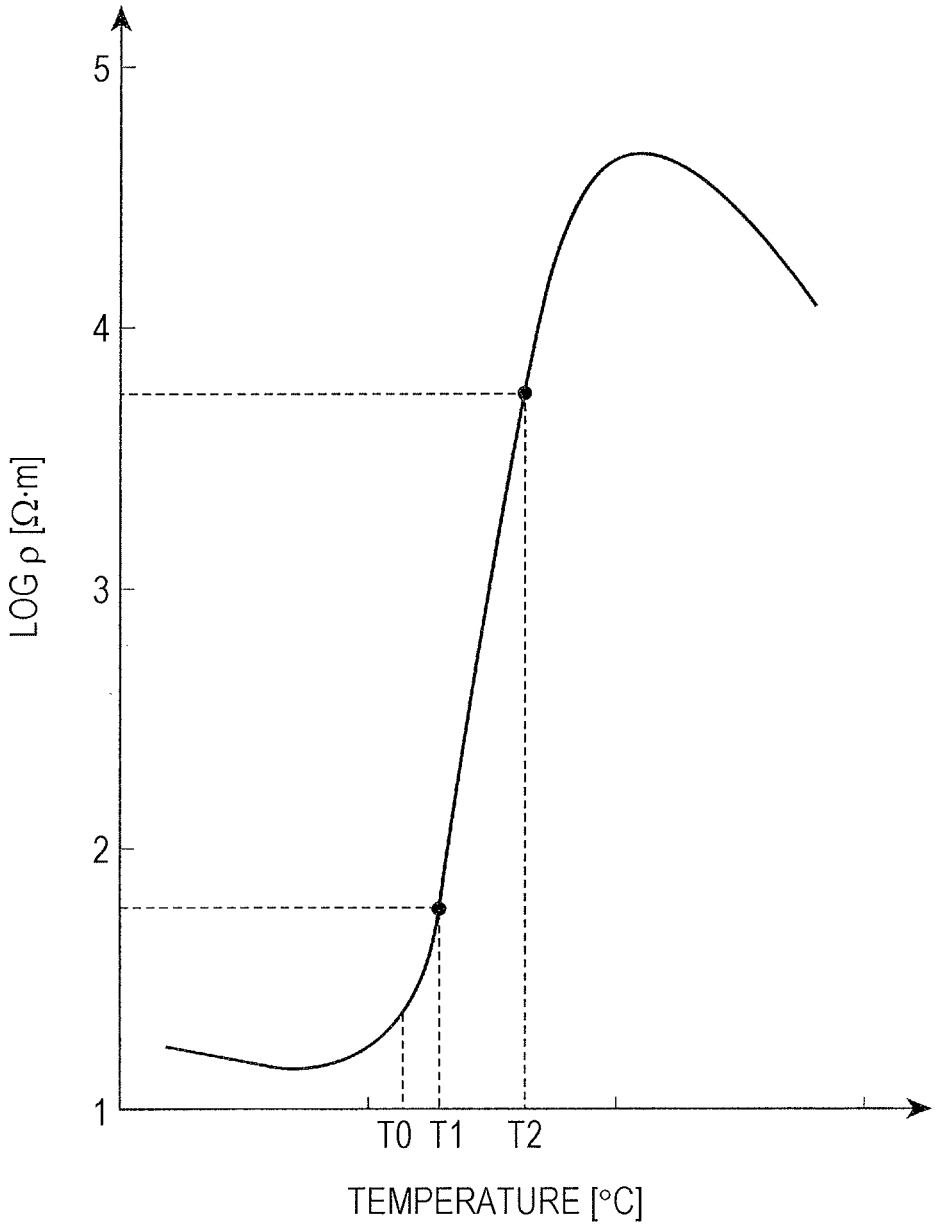
FIG. 6 is a characteristic chart illustrating the relationship between the temperature and the resistivity of PTC elements.

FIG. 6 is a characteristic chart illustrating the relationship between the temperature and the resistivity of the PTC elements 73. As illustrated in FIG. 6, the PTC elements 73 exhibit a characteristic having a positive temperature coefficient by which the resistivity steeply increases compared to a resistor formed of an ordinary metal material or the like at a temperature higher than the Curie temperature T0 degrees.

At a temperature lower than the Curie temperature T0 degrees (see FIG. 6), that is, at a so-called ordinary environmental temperature, a resistance R2 (see FIG. 5) of the PTC elements 73 is set to about one hundredth of the resistance R1 of the resistance heating elements 72. It is also set that, while the temperature of the PTC elements 73 increases from temperature T1 degrees exceeding the Curie temperature T0 degrees to temperature T2 degrees, the resistance R2 of the PTC elements 73 becomes about 20 to 100 times the resistance R1 of the resistance heating elements 72 after the resistance R2 has steeply increased.

It is noted that the resistance heating elements 72 and the PTC elements 73 are enclosed by the glass coat 75*b* stacked on the base material 75*a*. The glass coat 75*b* insulates the resistance heating elements 72 and the PTC elements 73 from the fixing belt 78. In this solid heater 71, a different insulating material may be used instead of the glass coat 75*b*.

The plural resistance heating elements 72 of the solid heater 71 are arranged in the longitudinal direction L of the solid heater 71 in the outer circumferential surface of the glass coat 75*b* in contact with the fixing belt 78. As illustrated in FIG. 3, the width of the resistance heating elements 72 in the longitudinal direction L is set to such a degree that the resistance heating elements 72 adjacent to one another are close to one another.

Each of the PTC elements 73 is a very small chip having dimensions of, for example, about 2 mm in length×2 mm in width×0.1 mm in thickness. Thus, the PTC elements 73 adjacent to one another are separated from one another by a distance greater than the distance between the adjacent resistance heating elements 72.

Thus, as illustrated in FIG. 3, in the outer circumferential surface of the glass coat 75*b* in contact with the fixing belt 78, the PTC elements 73 are disposed in and occupy respective regions S2 (each serving as the region where each of the plural resistance elements is disposed), the resistance heating elements 72 are disposed in and occupy respective regions S1 (each serving as the region where a corresponding one of the plural heating elements is disposed), and each of the regions S2 is smaller than a corresponding one of the regions S1.

Here, the relationships between the arrangement of the resistance heating elements 72 of the solid heater 71, the fixing belt 78 heated by the solid heater 71, and the widths W1 and W2 of the sheets P1 and P2 onto which the superposed toner images are fixed by the fixing unit 60 (see FIG. 2) are described. The fixing belt 78 is slightly shorter than the entire length of the solid heater 71 in the longitudinal direction L. This allows the fixing belt 78 to be heated to a substantially uniform temperature over an entire width W0 in the width direction W by the plural resistance heating elements 72 provided in the solid heater 71.

The width W2 (length in the width direction W) of the B4 sheets P2, which are large sheets out of the sheets P subjected to fixing in the nip portion N of the fixing unit 60, is, as illustrated in FIG. 3, about a length slightly shorter than the entire width W0 of the fixing belt 78 and corresponds to a length that extends across all the resistance heating elements 72 of the solid heater 71.

The width W1 (length in the width direction W) of the A4 sheets P1, which are small sheets out of the sheets P subjected to fixing in the nip portion N of the fixing unit 60, is, as illustrated in FIG. 3, a length shorter than the entire width W0 of the fixing belt 78 and corresponds to a length that does not reach two resistance heating elements 72 arranged at both ends out of the resistance heating elements 72 arranged in the longitudinal direction L of the solid heater 71.

That is, out of the resistance heating elements 72 arranged in the longitudinal direction L illustrated in FIG. 3, the resistance heating element 72 arranged at each end corresponds to a non-sheet-pass-through range (non-pass-through range) where the sheet P1 does not pass through when the A4 sheet P1 is subjected to fixing.

Description of Operations of the Heater Unit

Next, operations of the heater unit 70 according to the present exemplary embodiment are described.

The solid heater 71 generates heat when a current supplied from the power source 74 passes therethrough as illustrated in FIG. 5. At this time, the temperature of the PTC elements 73 is equal to or lower than the Curie temperature T0 degrees under the ordinary environmental temperature. Thus, the resistance R1 of the resistance heating elements 72 connected in series with the respective PTC elements 73 is about 100 times greater than the resistance R2 of the PTC elements 73. Accordingly, the PTC elements 73 consume far smaller amount of power than that consumed by the resistance heating elements 72 and do not generate heat. In contrast, the resistance heating elements 72 generate heat.

The fixing belt 78 is heated entirely in the width direction W by the resistance heating elements 72 through the glass coat 75*b* (see FIG. 4) at a part thereof looped over the solid heater 71 while being rotated in the arrow E direction as illustrated in FIG. 3. Thus, the temperature of the fixing belt 78 reaches a target temperature required to fix the superposed toner images. When the heated part of the fixing belt 78 is rotated to the nip portion N (see FIG. 2), the heated part of the fixing belt 78 is brought into contact with the sheet P. At this time, the unfixed superposed toner images held by the sheet P are heated by the fixing belt 78 and subjected to a pressure applied by the pressure pad 79 and the pressure roller 80 in the nip portion N. This causes the unfixed superposed toner images held by the sheet P are fixed onto the sheet P.

Here, in the case where the sheet P having been transported to the nip portion N is the B4 sheet P2, since the sheets P2 have the width W2 that is slightly shorter than the entire width W0 of the fixing belt 78, the entirety of the fixing belt 78 in the width direction W is brought into contact with the sheet P2. Thus, the temperature of the fixing belt 78 is reduced entirely in the width direction W. When the fixing belt 78 is rotated in the arrow E direction, and a part of the fixing belt 78 where the temperature has been reduced returns to the solid heater 71 as illustrated in FIG. 2, this part is heated to the target temperature again by the resistance heating elements 72 through the glass coat 75*b*.

At this time, since the glass coat 75*b* is cooled by heat exchange with the fixing belt 78, the PTC elements 73 enclosed by the glass coat 75*b* do not exceed the Curie temperature T0 degree (see FIG. 6). Accordingly, the heater unit 70 repeats the above-described operations (heat exchange between the glass coat 75*b* and the fixing belt 78 (heating the fixing belt 78 and reducing the temperature of the glass coat 75*b*), heat exchange between the fixing belt 78 and the sheet P2 (reducing the temperature of the fixing belt 78), and heat exchange between the fixing belt 78 and the glass coat 75*b*).

It is noted that when the PTC elements 73 are disposed upstream of the resistance heating elements 72 in the rotating direction of the fixing belt 78 (arrow E direction) in the solid heater 71, the temperature-reduced part of the fixing belt 78 at a stage before heated by the resistance heating elements 72 is brought into contact with the PTC elements 73 through the glass coat 75*b*. Thus, the PTC elements 73 are also cooled by heat exchange with the fixing belt 78. This may reduce the likelihood of the temperature of the PTC elements 73 reaching the Curie temperature T0 degrees.

In the case where the sheet P having been transported to the nip portion N (see FIG. 2) is the A4 sheet P1, since the sheets P1 have the width W1 (see FIG. 3) that is shorter than the entire width W0 of the fixing belt 78, the non-sheet-pass-through range is formed at each end (outside the width W1 of the sheet P1) of the fixing belt 78 in the width direction W. Since the non-sheet-pass-through ranges of the fixing belt 78 are not subjected to heat exchange performed by contact of the fixing belt 78 with the sheet P2 in the nip portion N, the degree of reduction in temperature in the non-sheet-pass-through ranges is less than that in a sheet-pass-through range through which the sheet P1 passes.

The non-sheet-pass-through ranges of the fixing belt 78 where the temperature is higher than that in the sheet-pass-through range return to the solid heater 71 and are heated again by the resistance heating elements 72 through the glass coat 75*b*. Repeating this operation maintains the temperature of the non-sheet-pass-through ranges of the fixing belt 78 at a temperature higher than the target temperature. Thus, the temperature of parts of the glass coat 75*b* corresponding to these non-sheet-pass-through ranges is not reduced but increased.

As a result, due to heat conduction from the parts of the glass coat 75*b* corresponding to the non-sheet-pass-through ranges, the temperature of the PTC elements 73 enclosed by these parts of the glass coat 75*b* increases and then exceeds the Curie temperature T0 degrees (see FIG. 6).

Figure 7:
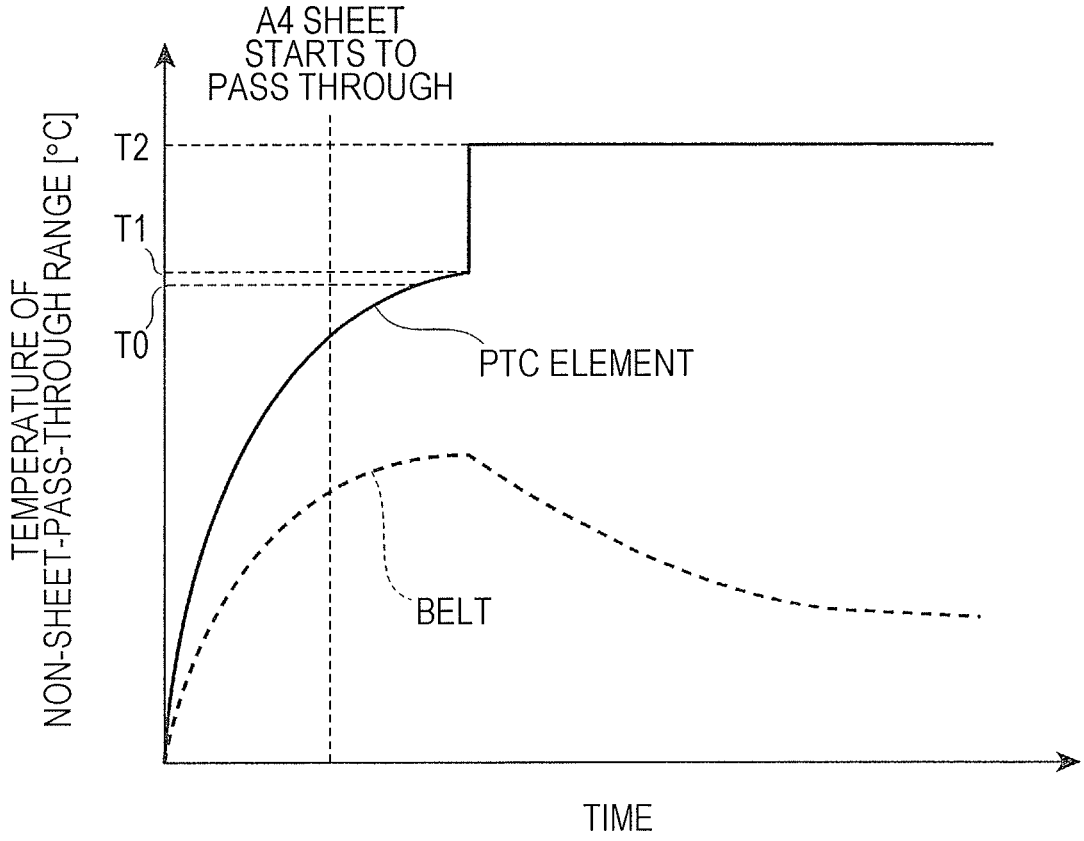
FIG. 7 illustrates the relationship between time elapsed from the start of passing of an A4 sheet through the fixing unit and the temperature of the PTC elements enclosed by parts of the glass coat corresponding to non-sheet-pass-through ranges.

FIG. 7 illustrates the relationship between time elapsed from the start of passing of the A4 sheet P1 through the fixing unit 60 and the temperature of the PTC elements 73 enclosed by the parts of the glass coat 75*b* corresponding to the non-sheet-pass-through ranges.

When the temperature of the PTC elements 73 in the parts corresponding to the non-sheet-pass-through ranges exceeds the Curie temperature T0 degrees, the resistivity of the PTC elements 73 steeply increases as illustrated in FIG. 6 and the resistance R2 (see FIG. 5) also increases. When the temperature of the PTC elements 73 reaches the temperature T1 degrees higher than the Curie temperature T0 degrees, the PTC elements 73 starts self-heating due to an effect of the increased resistance R2. As a result, as illustrated in FIG. 7, the temperature of the PTC elements 73 further steeply increases and instantaneously reaches the temperature T2 degrees that is higher than the temperature T1 degrees.

The resistivity of the PTC elements 73 the temperature of which has reached T2 degrees becomes, as seen from the characteristics illustrated in FIG. 6, equal to or more than several thousand times the resistivity under the normal environmental temperature, and the resistance R2 of the PTC elements 73 becomes 20 to 100 times the resistance R1 of the resistance heating elements 72. As a result, almost no current flows through the PTC elements 73 in the parts corresponding to the non-sheet-pass-through ranges and parts of the circuit connected in series with these PTC elements 73. Thus, the resistance heating elements 72 involved in heating of the fixing belt 78 do not generate heat.

Thus, the temperature of the parts of the glass coat 75*b* corresponding to the non-sheet-pass-through ranges starts to reduce, and the temperature of the non-sheet-pass-through ranges of the fixing belt 78 also starts to reduce and reaches the temperature lower than the target temperature as illustrated in FIG. 7.

As described above, the heater unit 70, the fixing unit 60, and the image forming apparatus 1 according to the present exemplary embodiment may prevent a situation in which the temperature of the non-sheet-pass-through ranges of the fixing belt 78, through which the sheet P does not pass, is maintained at a temperature higher than the target temperature depending on the difference in size of the passing sheets P. As a result, heat load applied to parts of the heater unit 70, the fixing unit 60, and so forth corresponding to the non-sheet-pass-through ranges (for example, fixing belt 78 (see FIG. 2) the support member 75, and so forth) may be reduced compared to that in a structure in which the non-sheet-pass-through ranges are continued to be heated similarly to or in the same manner as the sheet-pass-through range. By reducing the heat load, reduction in life of the parts of the heater unit 70, the fixing unit 60, and so forth corresponding to the non-sheet-pass-through ranges due to the heat load may be suppressed.

When the resistance R2 of these PTC elements 73 steeply increases, almost no current flows through these PTC elements 73. However, there still is a small amount of current flowing through the PTC elements 73. Accordingly, the temperature of the PTC elements 73 is maintained at the temperature T2 degrees as illustrated in FIG. 7.

The temperature T2 degrees is higher than the heating temperature of the resistance heating elements 72 in the sheet-pass-through range. However, since each of the regions S2 (see FIG. 3) where the PTC elements 73 are disposed is much smaller than a corresponding one of the regions S1 where the resistance heating elements 72 are disposed, even when the PTC elements 73 generate heat of the high temperature T2 degrees in the non-sheet-pass-through ranges, this does not become output sufficient to heat the non-sheet-pass-through ranges of the fixing belt 78 through the glass coat 75*b*.

Thus, the PTC elements 73 of the heater unit 70 according to the present exemplary embodiment do not have a function of heating the fixing belt 78.

As illustrated in FIG. 4, since the PTC elements 73 are disposed closer to the base material 75*a* than the resistance heating elements 72, the distance in the depth direction between the PTC elements 73 and the fixing belt 78 in contact with the outer circumferential surface of the glass coat 75*b* is greater than that between the resistance heating elements 72 and the fixing belt 78 in contact with the outer circumferential surface of the glass coat 75*b*. Accordingly, also from this viewpoint, the thermal effect produced by the PTC elements 73 on the fixing belt 78 is smaller than that produced by the resistance heating elements 72.

In the above description, in a part corresponding to the sheet-pass-through range through which the A4 sheet P1 passes, the temperature of the PTC elements 73 does not exceed the Curie temperature T0 degrees. Thus, operations of the resistance heating elements 72 and the PTC elements 73 in the part corresponding to the sheet-pass-through range is the same as those performed when the B4 sheet P2 passes through.

Other Exemplary Embodiments

Heat Conduction Suppressing Portion

Figure 8:
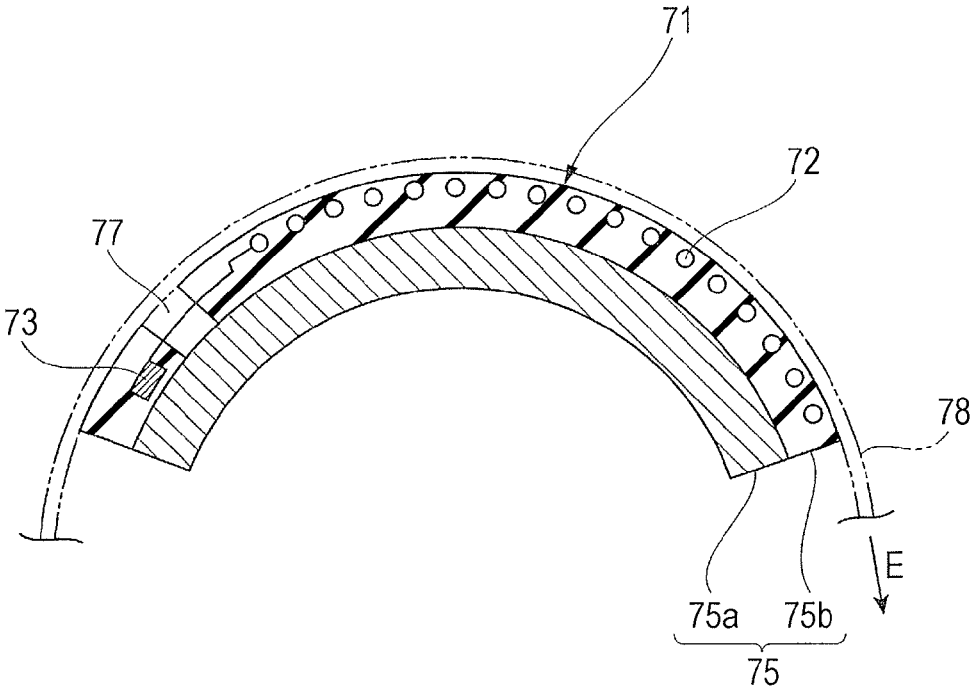
FIG. 8 is a sectional view corresponding to FIG. 4, illustrating a structure provided with a heat conduction suppressing portion, which suppresses heat conduction, between resistance heating elements and the PTC elements.

FIG. 8 is a sectional view corresponding to FIG. 4, illustrating a structure provided with a heat conduction suppressing portion 77, which suppresses heat conduction, between the resistance heating elements 72 and the PTC elements 73.

As illustrated in FIG. 4, the heater unit 70 according to the above-described exemplary embodiment has a structure in which the resistance heating elements 72 together with the PTC elements 73 each connected in series with a corresponding one of the resistance heating elements 72 are enclosed by the glass coat 75*b*. This heater unit 70 may include the heat conduction suppressing portion 77, which suppresses heat conduction, between the resistance heating elements 72 and the PTC elements 73 as illustrated in FIG. 8.

As the heat conduction suppressing portion 77, a portion or the like may be used in which a material having a lower heat conductivity than that of the glass coat 75*b* is disposed. For example, as illustrated in FIG. 8, by forming a slit in the glass coat 75*b*, an air layer is formed. This air layer may be used as the heat conduction suppressing portion 77. Alternatively, the heat conduction suppressing portion 77 may be formed by filling this slit with a material having a lower heat conductivity than that of the glass coat 75*b* such as resin or ceramic.

With the heater unit 70 provided with the heat conduction suppressing portion 77 between the resistance heating elements 72 and the PTC elements 73 as described above, even when heat generated by the resistance heating elements 72 is conducted to the glass coat 75*b*, the heat conduction suppressing portion 77 suppresses conduction of the heat from the glass coat 75*b* to the PTC elements 73.

As a result, a steep increase of the resistance R2 of the PTC elements 73 affected by heating of the resistance heating elements 72 is suppressed before the temperature of the resistance heating elements 72 reaches an objective temperature (the temperature with which the fixing belt 78 is heated to the temperature required to fix the unfixed superposed toner images onto the sheet P) so as to prevent the resistance heating elements 72 from stopping the heating before the temperature of the resistance heating elements 72 reaches the objective temperature.

Arrangement of the PTC Elements

Figure 9:
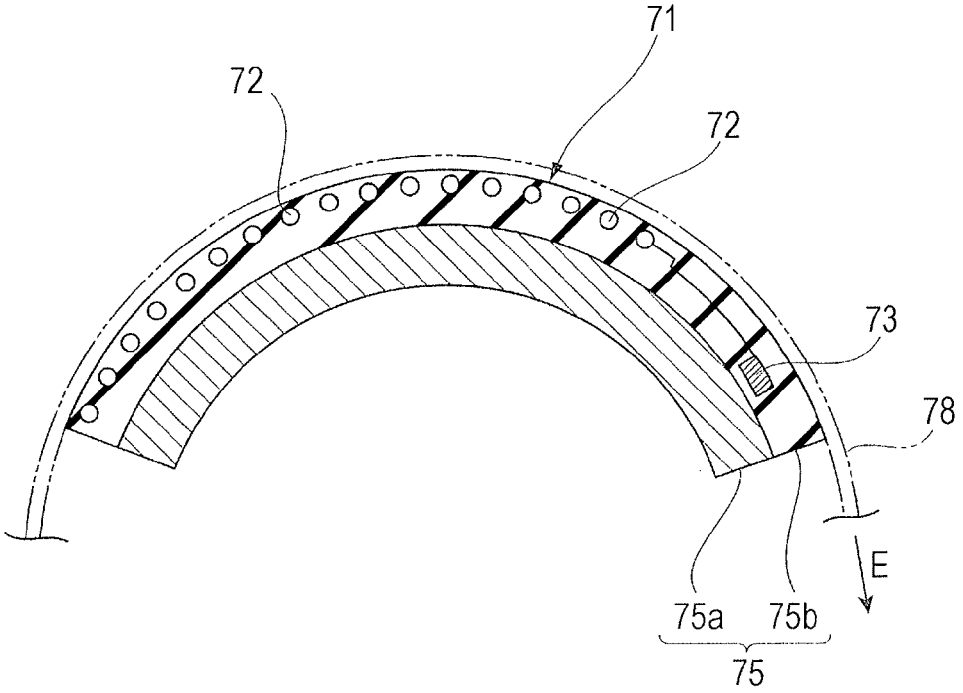
FIG. 9 is a sectional view corresponding to FIG. 4, illustrating the solid heater having a structure in which the PTC elements are disposed downstream of the resistance heating elements in an arrow E direction, which is a fixing belt rotating direction.

FIG. 9 is a sectional view corresponding to FIG. 4, illustrating the solid heater 71 having a structure in which the PTC elements 73 are disposed downstream of the resistance heating elements 72 in the arrow E direction, which is the fixing belt 78 rotating direction.

The PTC elements 73 are disposed downstream of the resistance heating elements 72 in the arrow E direction, which is the fixing belt 78 rotating direction, in the solid heater 71 illustrated in FIG. 9. Similarly to the solid heater 71 illustrated in FIG. 4, the solid heater 71 illustrated in FIG. 9 may prevent a situation in which the temperature of the parts of the fixing belt 78 corresponding to the non-sheet-pass-through ranges, through which the sheet P does not pass, is maintained at a temperature higher than the target temperature depending on the difference in size of the sheets P passing through the fixing unit 60.

As a result, heat load applied to the parts of the heater unit 70 (see FIG. 2), the fixing unit 60, and so forth corresponding to the non-sheet-pass-through ranges may be reduced compared to that in a structure in which the non-sheet-pass-through ranges are continued to be heated similarly to or in the same manner as the sheet-pass-through range. By reducing the heat load, reduction in life of the parts of the heater unit 70, the fixing unit 60, and so forth corresponding to the non-sheet-pass-through ranges due to the heat load may be suppressed.

Figure 10:
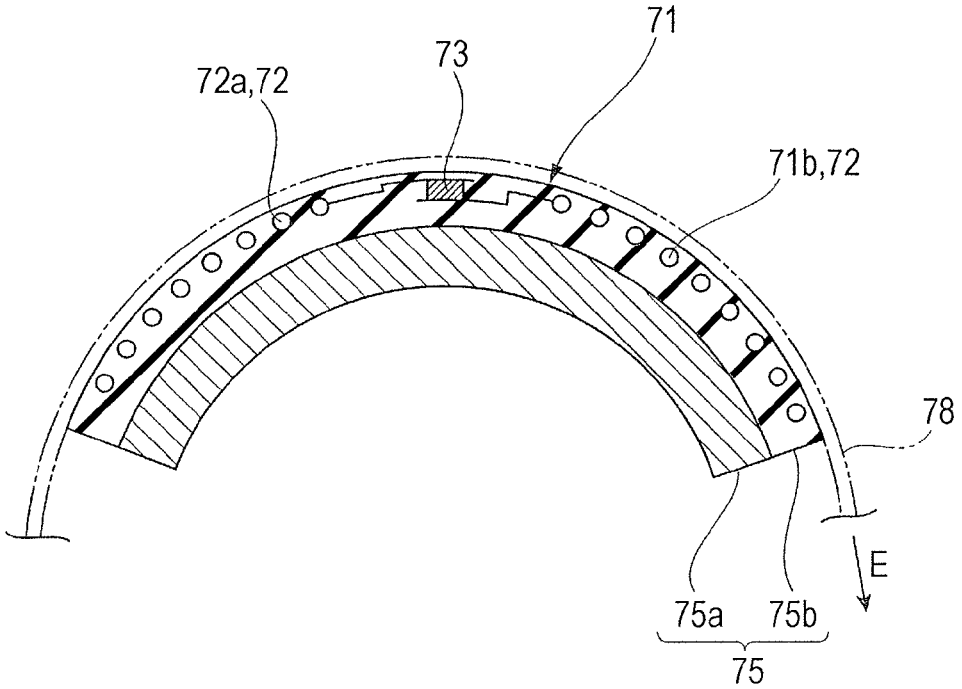
FIG. 10 is a sectional view corresponding to FIG. 4, illustrating the solid heater having a structure in which the PTC elements are disposed between the resistance heating elements on the relatively upstream side and the resistance heating elements on the relatively downstream side in the arrow E direction, which is the fixing belt rotating direction.

FIG. 10 is a sectional view corresponding to FIG. 4, illustrating the solid heater 71 having a structure in which the PTC elements 73 are disposed between resistance heating elements 72*a* on the relatively upstream side (the resistance heating elements 72 disposed on the relatively upstream side) and resistance heating elements 72*b* on the relatively downstream side (the resistance heating elements 72 disposed on the relatively downstream side) in the arrow E direction, which is the fixing belt 78 rotating direction.

In the solid heater 71 illustrated in FIG. 10, the PTC elements 73 are disposed downstream of the resistance heating elements 72*a* on the relatively upstream side in the arrow E direction, which is the fixing belt 78 rotating direction, and upstream of the resistance heating elements 72*b* on the relatively downstream side in the arrow E direction, which is the fixing belt 78 rotating direction.

Similarly to the solid heater 71 illustrated in FIG. 4, the solid heater 71 illustrated in FIG. 10 may prevent a situation in which the temperature of the non-sheet-pass-through ranges of the fixing belt 78, through which the sheet P does not pass, is maintained at a temperature higher than the target temperature depending on the difference in size of the sheets P passing through the fixing unit 60. As a result, heat load applied to the parts of the heater unit 70 (see FIG. 2), the fixing unit 60, and so forth corresponding to the non-sheet-pass-through ranges may be reduced compared to that in a structure in which the non-sheet-pass-through ranges are continued to be heated similarly to or in the same manner as the sheet-pass-through range. By reducing the heat load, reduction in life of the parts of the heater unit 70, the fixing unit 60, and so forth corresponding to the non-sheet-pass-through ranges due to the heat load may be suppressed.

Although an integrated structure is realized by arranging the PTC elements 73 on the support member 75, on which the the resistance heating elements 72 are also arranged, the PTC elements 73 are not necessarily arranged on the support member 75.

Shape of the Base Material

Figure 11:
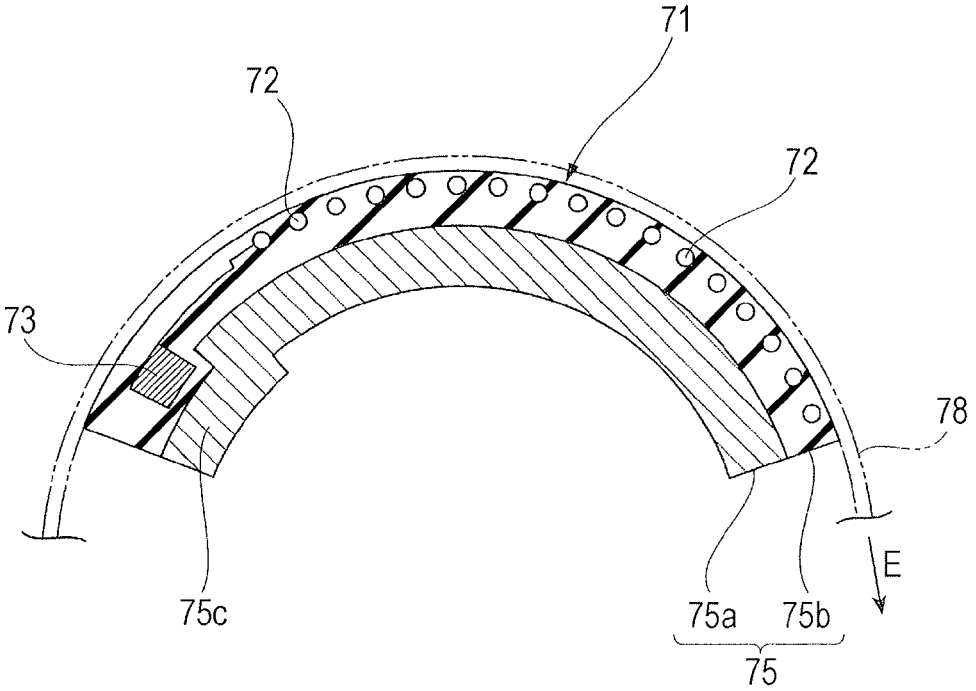
FIG. 11 is a sectional view corresponding to FIG. 4, illustrating a variation of the shape of a base material having steps formed therein when the thickness of the PTC elements is large.
Figure 12:
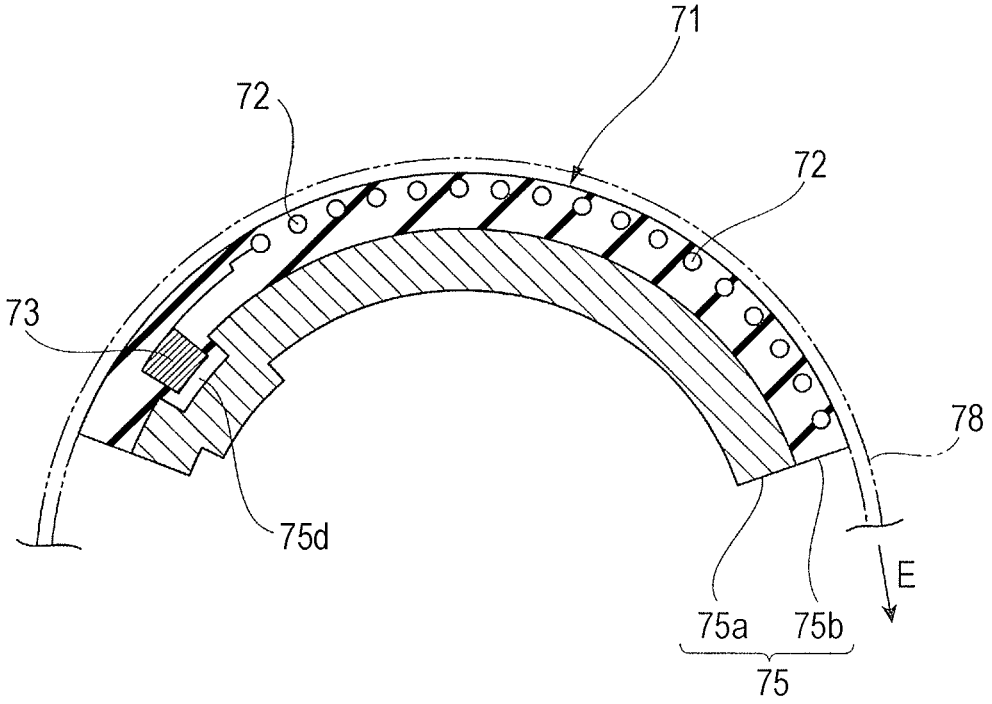
FIG. 12 is a sectional view corresponding to FIG. 4, illustrating a variation of the shape of a base material having recesses formed therein when the thickness of the PTC elements is large.

FIGS. 11 and 12, which are sectional views corresponding to FIG. 4, illustrating variations of the shape of the base material 75*a* when the thickness of the PTC elements 73 is larger than that of the PTC elements 73 illustrated in, for example, FIG. 4. Specifically, FIG. 11 illustrates a shape having steps 75*c* formed in the base material 75*a*, and FIG. 12 illustrates a shape having recesses 75*d* formed in the base material.

In the solid heater 71 illustrated in FIG. 11, portions of the base material 75*a* where the PTC elements 73 are disposed are lowered (the radius is reduced in the radial direction) due to the formation of the steps 75*c*, and the thickness of the glass coat 75*b* is increased in the amount by which the portions of the base material 75*a* are lowered. Thus, even when the thickness of the PTC elements 73 is larger than that of the PTC elements 73 illustrated in, for example, FIG. 4, the PTC elements 73 are disposed inside the glass coat 75*b*.

In the solid heater 71 illustrated in FIG. 12, portions of the base material 75*a* where the PTC elements 73 are disposed are lowered due to the formation of the recesses 75*d*, and the thickness of the glass coat 75*b* is increased in the amount by which the portions of the base material 75*a* are lowered. Thus, even when the thickness of the PTC elements 73 is larger than that of the PTC elements 73 illustrated in, for example, FIG. 4, the PTC elements 73 are disposed inside the glass coat 75*b*.

Shape of the Support Member

Figure 13:
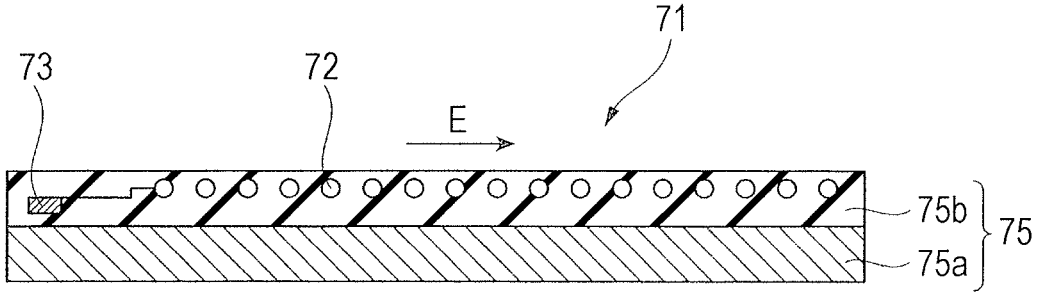
FIG. 13 is a sectional view corresponding to FIG. 4, illustrating a variation of the shape of a support member having a flat shape.
Figure 14:
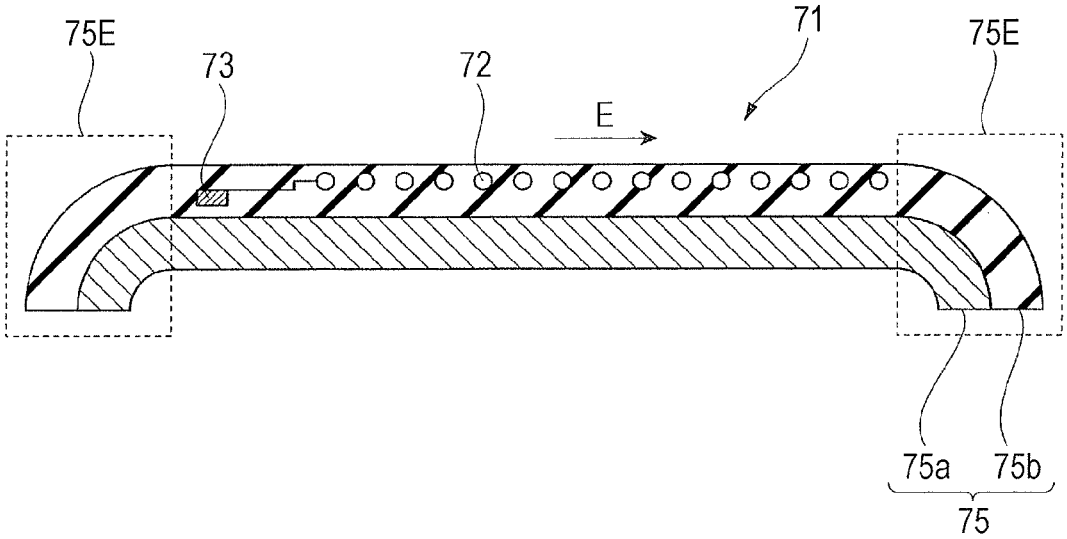
FIG. 14 is a sectional view corresponding to FIG. 4, illustrating a variation of the shape of the support member formed by rounding end portions of the flat support member illustrated in FIG. 13, the end portions being located on the upstream side and the downstream side in the arrow E direction, which is the fixing belt rotating direction.

FIGS. 13 and 14 are sectional views corresponding to FIG. 4, illustrating variations of the shape of the support member 75. Specifically, FIG. 13 illustrates the support member 75 having a flat shape, and FIG. 14 illustrates the support member 75 formed by rounding end portions 75E of the flat support member 75 illustrated in FIG. 13, the end portions 75E being located on the upstream side and the downstream side in the arrow E direction, which is the fixing belt 78 rotating direction.

With the solid heater 71 having the support member 75 illustrated in FIG. 13 or 14 as described above, heat may be conducted to the fixing belt 78 rotating in the arrow E direction while being in contact with the surface of the glass coat 75*b* (see FIG. 4).

Electrodes of the Electrical Circuit

Figure 15:
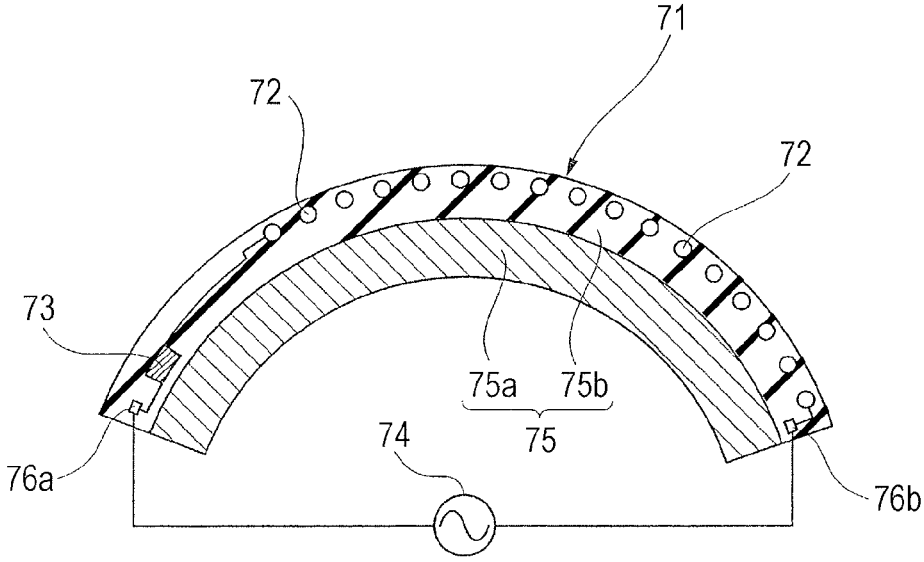
FIG. 15 is a schematic view in which the electrical circuit illustrated in FIG. 5 is represented in the sectional view illustrated in FIG. 4.

FIG. 15 is a schematic view in which the electrical circuit illustrated in FIG. 5 is represented in the sectional view illustrated in FIG. 4. As illustrated in FIG. 15, the support member 75 of the solid heater 71 illustrated in FIG. 4 is actually provided with a first electrode 76*a* and a second electrode 76*b*. The first electrode 76*a* is connected to the PTC elements 73 and the second electrode 76*b* is connected to the resistance heating elements 72. The electrical circuit illustrated in FIG. 5 is formed by connecting the first electrode 76*a* and the second electrode 76*b* to the power source 74.

Figure 16:
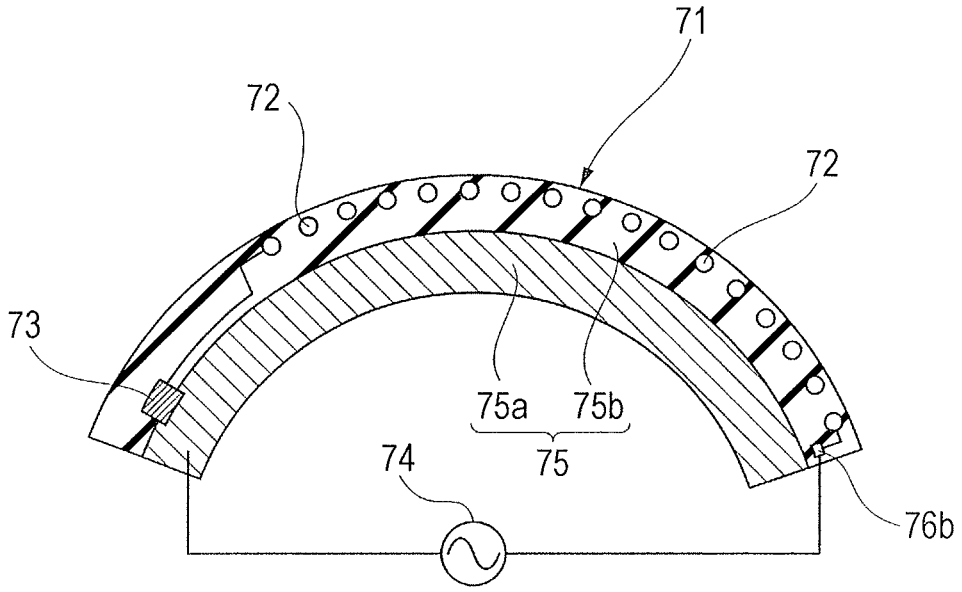
FIG. 16 is a schematic view of a structure in which the PTC elements illustrated in FIG. 15 are connected to an electrically conductive base material, and this base material and a second electrode are connected to a power source.

FIG. 16 is a schematic view of a structure in which the PTC elements 73 illustrated in FIG. 15 are connected to the electrically conductive base material 75*a*, and this base material 75*a* and the second electrode 76*b* are connected to the power source 74. Since the base material 75*a* illustrated in FIG. 16 functions as the first electrode 76*a* illustrated in FIG. 15, the structure of the solid heater 71 may be more simplified than that of the solid heater 71 in which the first electrode 76*a* is formed.

It is noted that a region of the surface of the base material 75*a* of the solid heater 71 illustrated in FIG. 16 except for parts connected to the power source 74 may be insulated from surrounding members by, for example, covering this region by an insulating layer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating device comprising:

a belt member that is rotated;

a support member disposed on an inside of the belt member, the support member comprising a base material and an insulating material provided between the base material and the belt member;

a plurality of heating elements that are enclosed by the insulating material of the support member and are arranged in a width direction of the belt member, the plurality of heating elements generating heat so as to heat the belt member; and a plurality of resistance elements that are enclosed by the insulating material of the support member and that have positive temperature coefficients, the plurality of resistance elements each being connected in series with a corresponding one of the plurality of heating elements.

2. The heating device according to claim 1, wherein the plurality of resistance elements are each disposed in a region and the plurality of heating elements are each disposed in a region, and wherein the region where each of the plurality of resistance elements is disposed is smaller than the region where a corresponding one of the plurality of heating elements is disposed.

3. The heating device according to claim 1, wherein a heat conduction suppressing portion that suppresses conduction of heat is provided between the plurality of resistance elements and the plurality of heating elements.

4. The heating device according to claim 1, wherein a temperature of the belt member is reduced by an increase in resistances of the plurality of resistance elements caused by an increase in temperatures of the plurality of resistance elements.

5. The heating device according to claim 1, wherein the base material is stainless steel, or a clad material formed by combining stainless steel and copper in a thickness direction of the base material.

6. The heating device according to claim 5, wherein the insulating material is a glass coat.

7. The heating device according to claim 1, wherein the insulating material is a glass coat.

8. The heating device according to claim 1, wherein the resistance elements are disposed upstream of the heating elements in a rotation direction of the belt member.

9. A fixing device comprising:

a heating device that includes a belt member that is rotated, a support member disposed on an inside of the belt member, the support member comprising a base material and an insulating material provided between the base material and the belt member;

a plurality of heating elements that are enclosed by the insulating material of the support member and are arranged in a width direction of the belt member, the plurality of heating elements generating heat so as to heat the belt member; and a plurality of resistance elements that are enclosed by the insulating material of the support member and that have positive temperature coefficients, the plurality of resistance elements each being connected in series with a corresponding one of the plurality of heating elements; and a pressure member that is in contact with the belt member heated by the plurality of heating elements so as to form a nip portion by which a plurality of types of recording media, which have different sizes in the width direction, are nipped, wherein at least one of the plurality of heating elements and at least one of the plurality of resistance elements are disposed at respective positions corresponding to a non-pass-through range, through which one of the recording media having a smallest size out of the plurality of types of recording media nipped by the nip portion does not pass, in a longitudinal direction of the heating device.

10. The fixing device according to claim 9, wherein a temperature of the belt member is reduced by an increase in resistances of the plurality of resistance elements caused by an increase in temperatures of the plurality of resistance elements.

11. An image forming apparatus comprising:

a fixing device that includes a belt member that is rotated, a support member disposed on an inside of the belt member, the support member comprising a base material and an insulating material provided between the base material and the belt member;

a plurality of heating elements that are enclosed by the insulating material of the support member and are arranged in a width direction of the belt member, the plurality of heating elements generating heat so as to heat the belt member, and a plurality of resistance elements that are enclosed by the insulating material of the support member and that have positive temperature coefficients, the plurality of resistance elements each being connected in series with a corresponding one of the plurality of heating elements; and a transport unit that transports a plurality of types of recording media, which have different sizes in the width direction, toward the fixing device, wherein at least one of the plurality of heating elements and at least one of the plurality of resistance elements are disposed at respective positions corresponding to a non-pass-through range, through which one of the recording media having a smallest size out of the plurality of types of recording media transported by the transport unit does not pass, in a longitudinal direction of the fixing device.

12. The image forming apparatus according to claim 11, wherein a temperature of the belt member is reduced by an increase in resistances of the plurality of resistance elements caused by an increase in temperatures of the plurality of resistance elements.

* * * * *